US006662389B1

(12) United States Patent
Carroll

(10) Patent No.: US 6,662,389 B1
(45) Date of Patent: Dec. 16, 2003

(54) COMPOSITE FABRIC AND FABRIC PRODUCT WITH VARIABLE THERMAL INSULATION

(76) Inventor: Arthur B. Carroll, 207 Ridgewood Dr., Georgetown, TX (US) 78628

( * ) Notice: Subject to any disclaimer, the term of this patent is extended or adjusted under 35 U.S.C. 154(b) by 18 days.

(21) Appl. No.: 10/180,810

(22) Filed: Jun. 25, 2002

(51) Int. Cl.[7] ..... A47G 9/00
(52) U.S. Cl. ..... 5/413 AM; 5/711
(58) Field of Search ..... 5/413 AM, 420, 5/711, 710, 644, 654; 139/387 R, 389; 428/35.2

(56) References Cited

U.S. PATENT DOCUMENTS

| | | | | |
|---|---|---|---|---|
| 2,620,493 A | * | 12/1952 | Brelsford | 5/700 |
| 3,008,214 A | * | 11/1961 | Foster et al. | 428/12 |
| 4,092,750 A | | 6/1978 | Ellis | 5/343 |
| 4,194,041 A | | 3/1980 | Gore et al. | 428/315 |
| 4,416,641 A | | 11/1983 | Spinosa et al. | 441/94 |
| 6,299,965 B1 | * | 10/2001 | Keshavaraj | 428/125 |
| 6,595,244 B1 | * | 7/2003 | Sollars, Jr. | 139/389 |

* cited by examiner

*Primary Examiner*—Teri Pham Luu
*Assistant Examiner*—Fredrick Conley
(74) *Attorney, Agent, or Firm*—Richard F. Frankeny; Winstead Sechrest & Minick P.C.

(57) ABSTRACT

A composite fabric is made from a fabric layer which has one or more expandable bladders coupled at spaced intervals across the surface of the fabric layer and extending substantially transverse to said spaced intervals a bladder length across the surface of the fabric layer. The expandable bladders are attached by threading them through fabric loop attached to the surface the fabric layer. The expandable bladders are coupled to an air source with air valves and selectively inflated and deflated. As the expandable bladders are inflated and deflated, they selectively cover and uncover area adjacent to their corresponding bladder lengths. The expandable bladders may be formed in various configurations and the fabric loops may or may not be stretchable. The composite fabric may be used to construct fabric products with various functional shapes where the thermal insulation across one or more surface areas of the fabric products are varied.

50 Claims, 16 Drawing Sheets

COMPOSITE FABRIC AND FABRIC PRODUCT WITH VARIABLE THERMAL INSULATION

TECHNICAL FIELD

The present invention relates in general to composite fabrics and in particular to composite fabrics with features that allow user adjustment of the fabric thermal insulation properties.

BACKGROUND INFORMATION

Man has been using clothing for a considerable time to help in the adaptation to the world's variable and sometimes harsh environment. Because of the many variations in the world's environment, the fabric that makes up clothing is required to do many duties. Sometimes the environment requires insulation to protect against cold temperatures. Many times these cold temperatures are accompanied with wind and rain. Therefore the fabrics that makes up the clothing may need to be able to keep water out while also keeping heat next to the clothing wearer where it is needed. If the cold weather occurs during sunny conditions, then the user may be faced with having to change clothing as the temperature varies. Usually this is done by applying clothing in layers. When the clothing is in layers, then the user may remove selected layers of clothing as the temperature warms up. While wearing clothing in layers is effective, many times it is cumbersome to remove and store the clothing layers.

Some companies (e.g., Gore Tex Corp.) have developed materials with a fabric pore size such that water molecules cannot penetrate yet water vapor can escape. While this solves the problem of keeping moisture out and at the same time allowing the fabric to breathe, it does not solve the problem of how to deal with a requirement for a variable thermal insulation for clothing. For example, if one dresses for a cold morning and the sun comes out, then the additional thermal energy may require a person to remove clothing layers or to make some adjustment for the added heat load.

A dead air space is known to be a very good thermal insulator. This concept is used effectively in air mattresses and other inflatable materials to provide insulation or cushioning. While some manufacturers have tried to use air in materials for garment clothing, it has resulted in bulky garments with a very course control of insulation. Most of these manufacturers use the thickness of the air space to control the amount of insulation. Since creating pockets of air requires that the pockets be impervious to the air molecule, this precludes the use of materials that naturally breathe. It is difficult to design a composite fabric that allows the use of air as an insulator, allows easy inflation and deflation, and allows the use of materials that naturally breathe.

Sometimes it is desirable for clothing required for variable weather conditions to have the ability to vary its thermal insulation at selected areas rather than over the entire garment. In this way, only those portions of a user's body that need additional insulation would be affected. For example, one may have their back against damp ground while their front is exposed to direct sunlight. It would be desirable to be able to change the thermal insulation of the garment covering one's back to have one thermal insulation value while adjusting the thermal insulation of the garment covering the front to have a different thermal insulation value.

There is, therefore, a need for a composite fabric that enables adjustments of thermal insulation in selected areas while maintaining the ability to use fabrics that naturally breathe in other selected areas.

SUMMARY OF THE INVENTION

A composite fabric is formed by attaching one or more expandable bladders to a surface of a first fabric layer at spaced intervals across the surface and extending corresponding bladder lengths across the surface in a direction substantially transverse to a direction of the spaced intervals. The expandable bladders define fabric areas of the first fabric layer adjacent to each of the corresponding bladder lengths of the expandable bladders. In one embodiment, each expandable bladder is attached to the first fabric layer by one or more fabric loops. The expandable bladders are threaded through corresponding fabric loops that extend across the surface of the fabric layer. The expandable bladders are coupled, singly or in groups, via an air valve that connects to an air source for selectively inflating and deflating the expandable bladders. When selected, expandable bladders are inflated and deflated and the fabric areas along and adjacent to the selected expandable bladders are selectively covered and uncovered by the selected expandable bladders. In this manner, the thermal insulation of the defined fabric areas of the fabric layer are varied.

In one embodiment, the fabric loops extend continuously across the fabric layer. Each fabric loop is made from a non-stretch fabric and essentially hangs in folds when the expandable bladders in the fabric loops are deflated. The fabric loops may be porous and offer little insulation value so that the characteristics of the first fabric layer are preserved when not covered by expandable bladders. The expandable bladders may be made to have a certain compressed shape when the air inside is evacuated. In another version of this embodiment, the fabric loops are segmented across the length of the fabric layer and do not cover the entire bladder lengths of corresponding threaded expandable bladders.

In another embodiment of the present invention, the fabric loops are made from a material that, while porous, stretches in a radial direction with little or no length expansion. The expandable bladders are threaded through corresponding fabric loops and assume a compressed shape smaller than the diameter of a non-expanded fabric loop. When air is supplied to selected expandable bladders, they unfold, expand, and stretch their corresponding fabric loops thereby selectively covering the fabric area adjacent to and along the bladder lengths of the selected expandable bladders. In this manner, the thermal insulation of the fabric area of the selected expandable bladders is varied. In this embodiment, the fabric loops may also be segmented across the length of the fabric layer.

In one embodiment, the expandable bladders are made as tubes of thin material that may be folded to a minimum cross-section within a fabric loop. When the expandable bladders are pressurized with air, they unfold and either fill or expand a corresponding fabric loop. In another embodiment, the expandable bladders have a cross-section geometry designed so that they assume a certain collapsed shape when evacuated. These extendable bladders unfold in a controlled geometry when filling or expanding a corresponding fabric loop. In yet another embodiment, the expandable bladder is made from a balloon-like structure that expands rapidly to a fixed diameter when inflated. The tapered wall thickness of a balloon-like expandable bladder causes its expansion to progress along its bladder length as it is pressurized. This balloon-like expandable bladder varies the thermal insulation of the fabric layer by selectively covering and uncovering the fabric area as its inflation and deflation progresses across its bladder length.

The composite fabric may be used to make fabric products with various functional shapes. For example, a fabric garment may be made by piecing together sections of composite fabric made according to embodiments of the present invention. A user may selectively inflate expandable bladders to modify and control the thermal insulation across selected areas of the fabric garment. Various fabric products may be formed by using the composite fabric made according to embodiments of the present invention including, but not limited to, tents, sleeping bags, backpacks, shoes, boots, and garments worn by an individual.

The expandable bladders may be coupled to an air source with various air valves so that a user may also selectively inflate and deflate expandable bladders. The expandable bladders may also be connected in series so that an entire area of the fabric layer may be controlled with one air valve. The couplings that connect expandable bladders in series may be designed to be flexible to facilitate bending a composite fabric layer.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
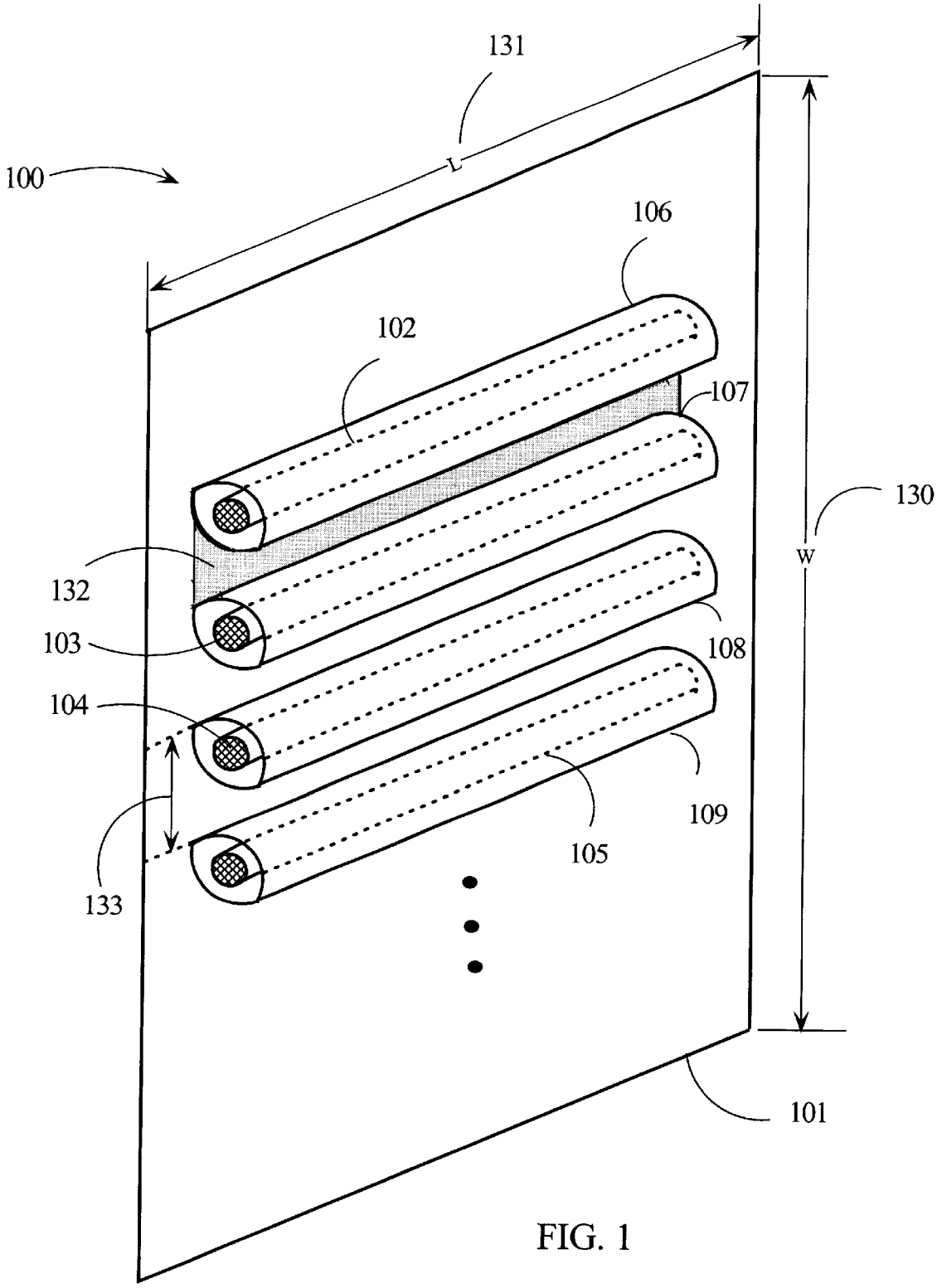
FIG. 1 illustrates a fabric layer having expandable bladders coupled with fabric loops that do not stretch.

In the following description, numerous specific details are set forth to provide a thorough understanding of the present invention. However, it will be obvious to those skilled in the art that the present invention may be practiced without such specific details. For the most part, details concerning manufacturing processes, materials and the like may have been omitted in as much as such details are not necessary to obtain a complete understanding of the present invention and are within the skills of persons of ordinary skill in the relevant art.

Refer now to the drawings wherein depicted elements are not necessarily shown to scale and wherein like or similar elements are designated by the same reference numeral through the several views.

FIG. 1 illustrates composite fabric 100 made according to an embodiment of the present invention using fabric layer 101 with width 130 and length 131. Fabric layer 101 has fabric loops 106–109 attached along its length 131 and spaced at intervals 133 across its width 130. While the space intervals 133 are shown uniform in FIG. 1, non-uniform space intervals are within the scope of the present invention. Expandable bladders 102–105 are threaded through corresponding fabric loops 106–109. Fabric layer 101 may be made from regular material or a special material, for example, a special material that passes water vapor while blocking liquid water. The embodiment of FIG. 1 illustrates fabric loops 106–109 that do not stretch, but rather assume a form dictated by the expansion of corresponding expandable bladders 102–105. Likewise, expandable bladders 102–105 may be made to expand by unfolding or stretching and thinning their corresponding wall thickness. Area 132 is defined as the space along and adjacent to expandable bladders 102 and 103. Area 132 is partially covered by the areas occupied by deflated expandable bladders 102 and 103. Since the areas occupied by deflated expandable bladders 102 and 103 are small relative to area 132, the characteristics of fabric layer 101 in area 132 are only slightly modified by the presence of the material of expandable bladders 102 and 103. The material of fabric loops 106–109 may be made porous so that fabric loops 106–109 do little to alter the characteristics of fabric layer 101 when their corresponding expandable bladders 102–105 are deflated. While fabric layer 101 is shown as a rectangular shape with a length 131 and width 130, it is understood that fabric layer 101 may have any regular or irregular shape and still be within the scope of the present invention. Illustrating fabric layer 101 with a regular length and width is used only to facilitate explanation of the present invention. The intervals between expandable bladders (e.g., D 133) are sized such that expandable bladders 102–105, when fully expanded, will substantially cover and maximally insulate an area of fabric layer 101. For example, when exemplary expandable bladders 102 and 103 are fully expanded (not shown expanded in this view), area 132 is thermally insulated by the volume of air contained within expandable bladders 102 and 103. Additionally air may be trapped between the expandable bladders 102 and 103 which also add insulation.

Figure 2:
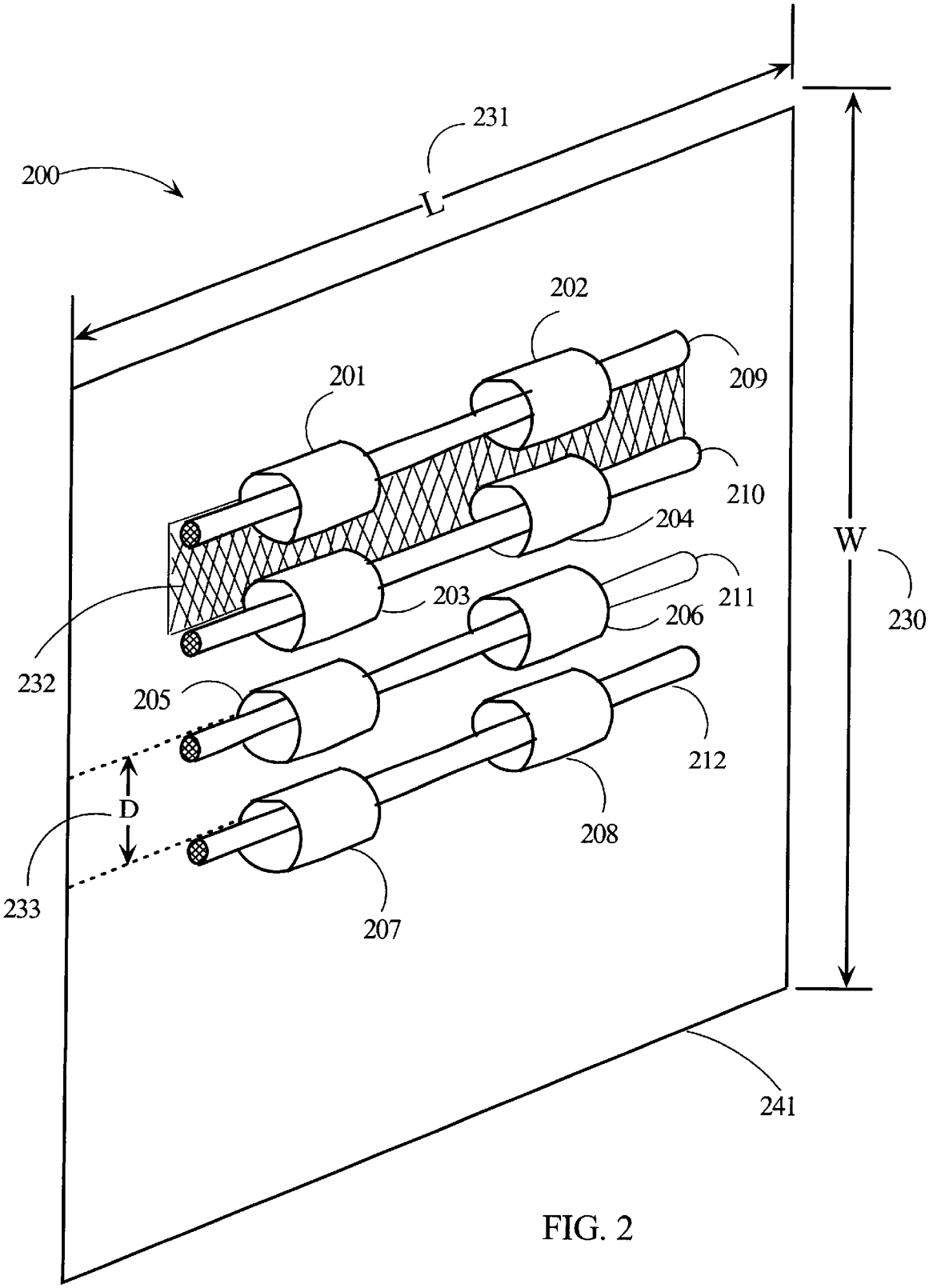
FIG. 2 illustrates a fabric layer having expandable bladders coupled with segmented fabric loops that do not stretch.

FIG. 2 illustrates composite fabric 200 having fabric layer 241 with width 230 and length 231. Fabric layer 241 has expandable bladders 209–212 attached with segmented fabric loops 201–208. Segmented fabric loops 201–208 hold corresponding expandable bladders 209–212. Fabric layer 241 may be made from regular material or special material, for example, a special material that passes water vapor while blocking liquid water. It may be desirable to use segmented fabric loops 201–208 to attach the corresponding expandable bladders 209–212 to reduce the bulk of the composite fabric panel 200. Fabric area 232 is formed by the area along and adjacent to expandable bladders 209 and 210. The fabric loops 201–208 are shown attached at uniform intervals 233 but may also be attached at non-uniform intervals and still be within the scope of the present invention. The intervals between expandable bladders (e.g., D 233) are sized such that expandable bladders 209–212, when fully expanded, will substantially cover and maximally insulate fabric layer 241. For example, when exemplary expandable bladders 209 and 210 are fully expanded (not shown expanded in this view), area 232 is thermally insulated by the volume of air contained within expandable bladders 209 and 210. Additionally air may be trapped between the expandable bladders 209 and 210 which also add insulation.

Figure 3:
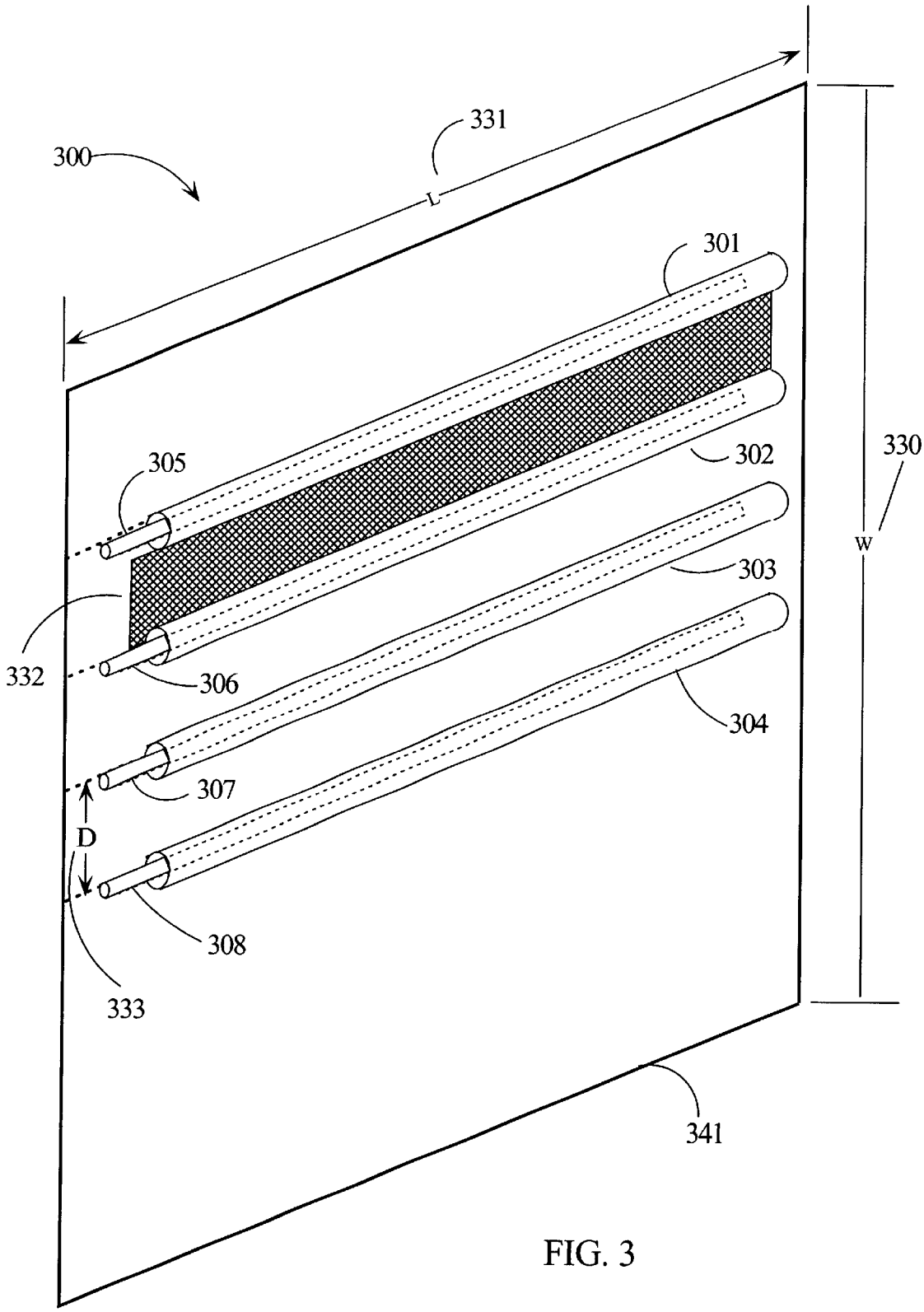
FIG. 3 illustrates a fabric layer having expandable bladders coupled with fabric loops that do stretch.
Figure 7:
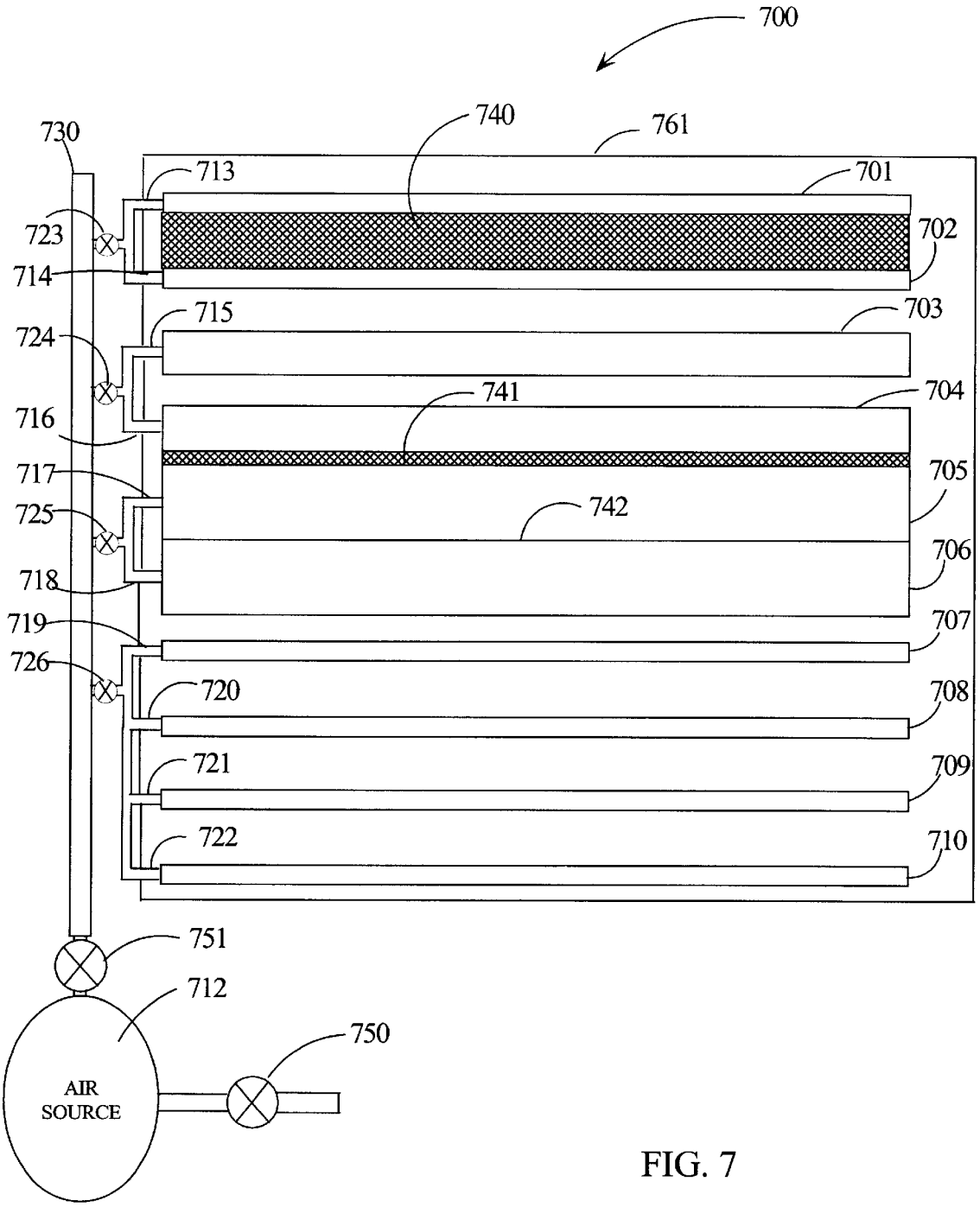
FIG. 7 illustrates a fabric layer with fabric loops with expandable bladders connected to an air source via air valves and an inflation tube.

FIG. 3 illustrates composite fabric 300 in another embodiment of the present invention. Composite fabric 300 is made with fabric layer 341 having width 330 and length 331. Fabric layer 341 has expandable bladders 305–308 attached with fabric loops 301–304 made from a material that stretches in a certain direction (e.g., Lycra® material). Expandable bladders 305–308 are threaded through corresponding fabric loops 301–304. Fabric loops 301–304 are spaced at intervals (e.g., D 333) along the width 330 of fabric layer 341. These intervals are sized so that the expanded diameters of adjacent ones of fabric loops 301–304 substantially touch when their corresponding threaded expandable bladders 305–308 are fully inflated. For example, when exemplary expandable bladders 305 and 306 are fully inflated (not shown expanded in this view), fabric area 332 is covered and is thermally insulated by the volume of air contained within expandable bladders 305 and 306. See, for example, FIG. 7 illustrating fully expanded bladders 717 and 718.

Figure 4:
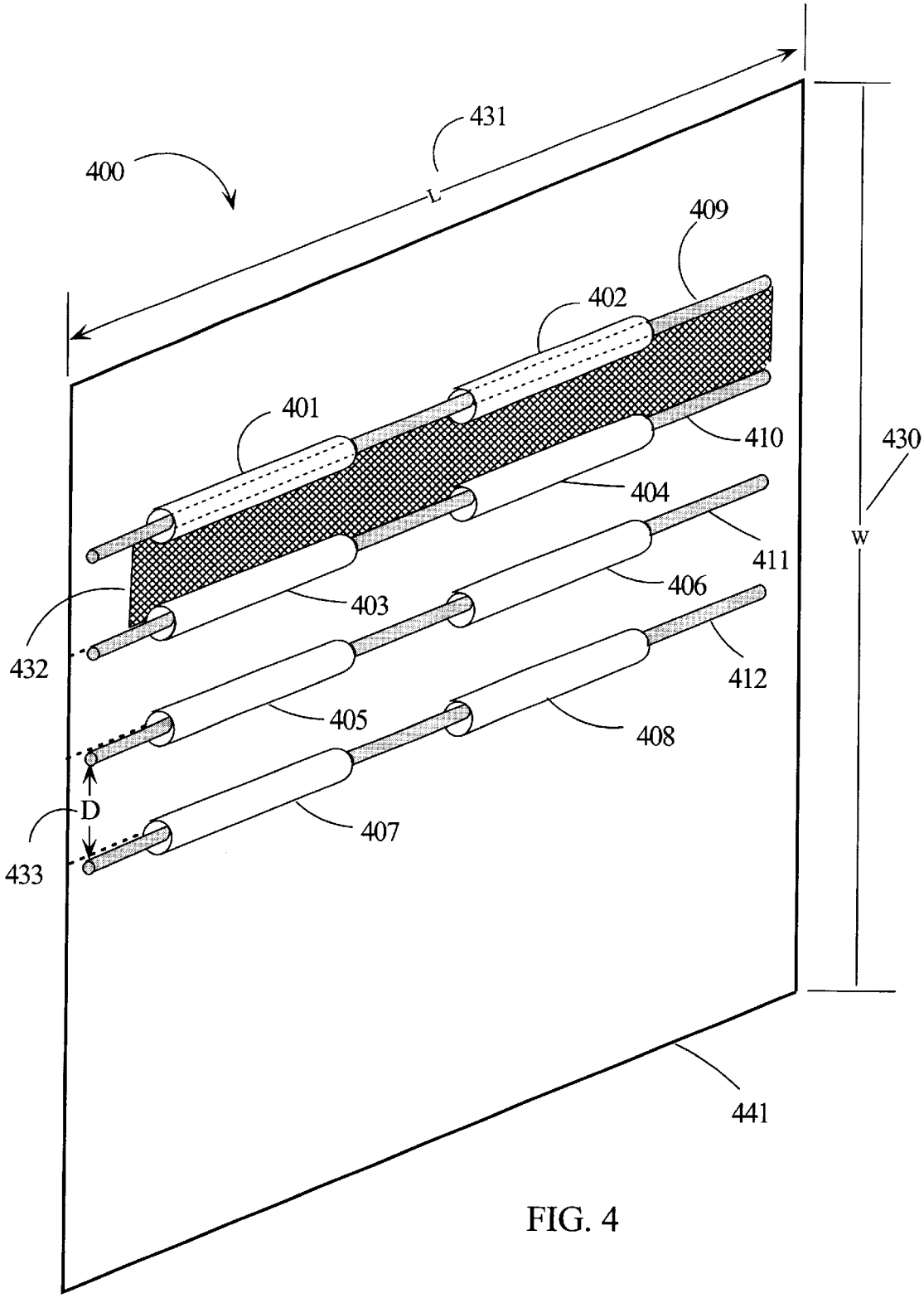
FIG. 4 illustrates a fabric layer having expandable bladders coupled with segmented fabric loops that do stretch.

FIG. 4 illustrates composite fabric 400 in another embodiment of the present invention. Composite fabric 400 is made with fabric layer 441 having width 430 and length 431. Fabric layer 441 has expandable bladders 409–412 attached with fabric loops 401–408 made from a material that stretches in a certain direction (e.g., Lycra® material). Expandable bladders 409–412 are threaded through corresponding fabric loops 401–408. Fabric loops 401–408 are spaced at intervals (e.g., D 433) along the width 430 of fabric layer 441. These intervals are sized so that the expanded diameters of adjacent ones of fabric loops 401–408 substantially touch when corresponding expandable bladders 409–412 are fully inflated. For example, when expandable bladders 409 and 410 are fully inflated, fabric area 432 is covered and is thermally insulated by the volume of air contained within expandable bladders 409 and 410. It may be desirable to use segmented fabric loops 401–408 to attach the corresponding expandable bladders 409–412 to reduce the bulk of the composite fabric 400.

Figure 5A:
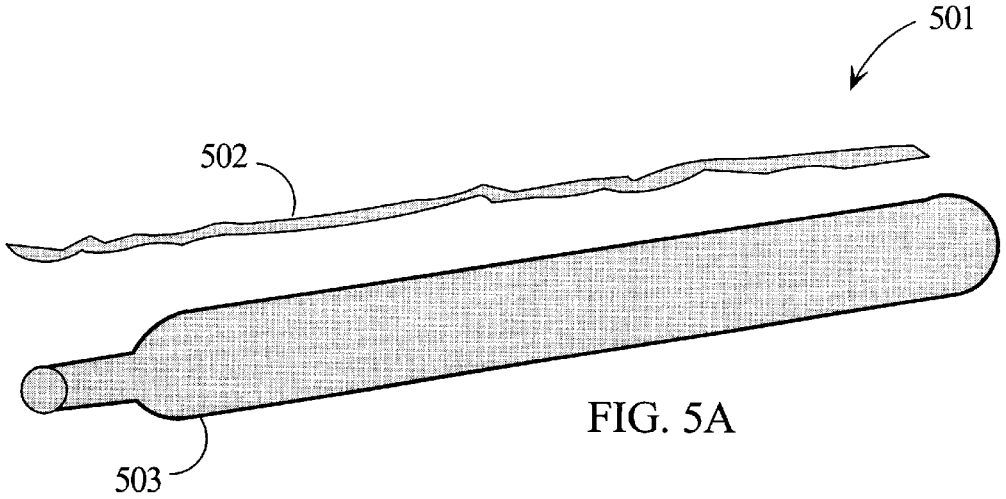
FIGS. 5A, 5B, and 5C illustrate three types of expandable bladders usable in embodiments of the present invention.
Figure 5B:
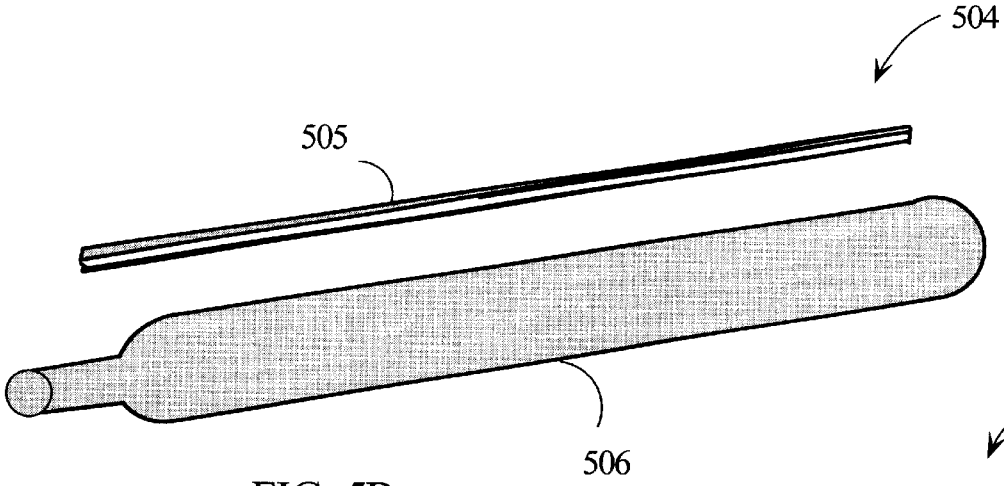
Figure 5C:
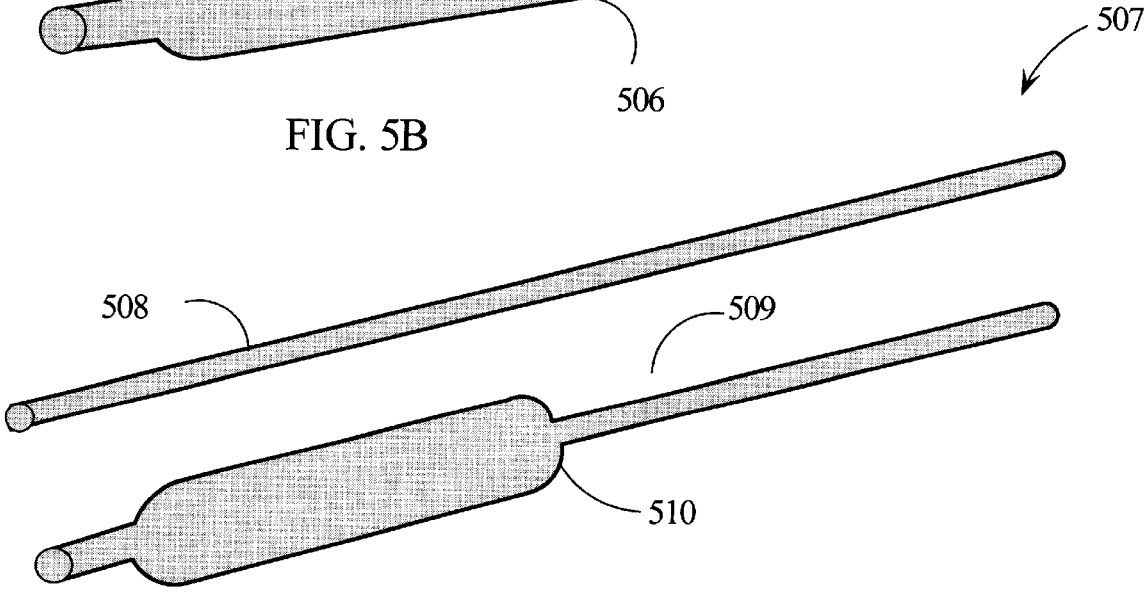

FIGS. 5A, 5B and 5C illustrate various types of inflatable bladders that may be used in embodiments of the present invention. In FIG. 5A, inflatable bladder 501 is shown in its inflated state 503 and deflated state 502. Inflatable bladder 501 is of the type that unfolds when it is inflated and expands without stretching. For example, the cylindrical plastic tube used to protect a delivered newspaper illustrates a bladder like inflatable bladder 501. When air is removed, inflatable bladder 501 may flatten under external air pressure and may not assume any particular shape. Inflatable bladder 501 may be further compressed if threaded through a fabric loop (e.g., fabric loop 301) that contracts when not expanded.

Figure 15:
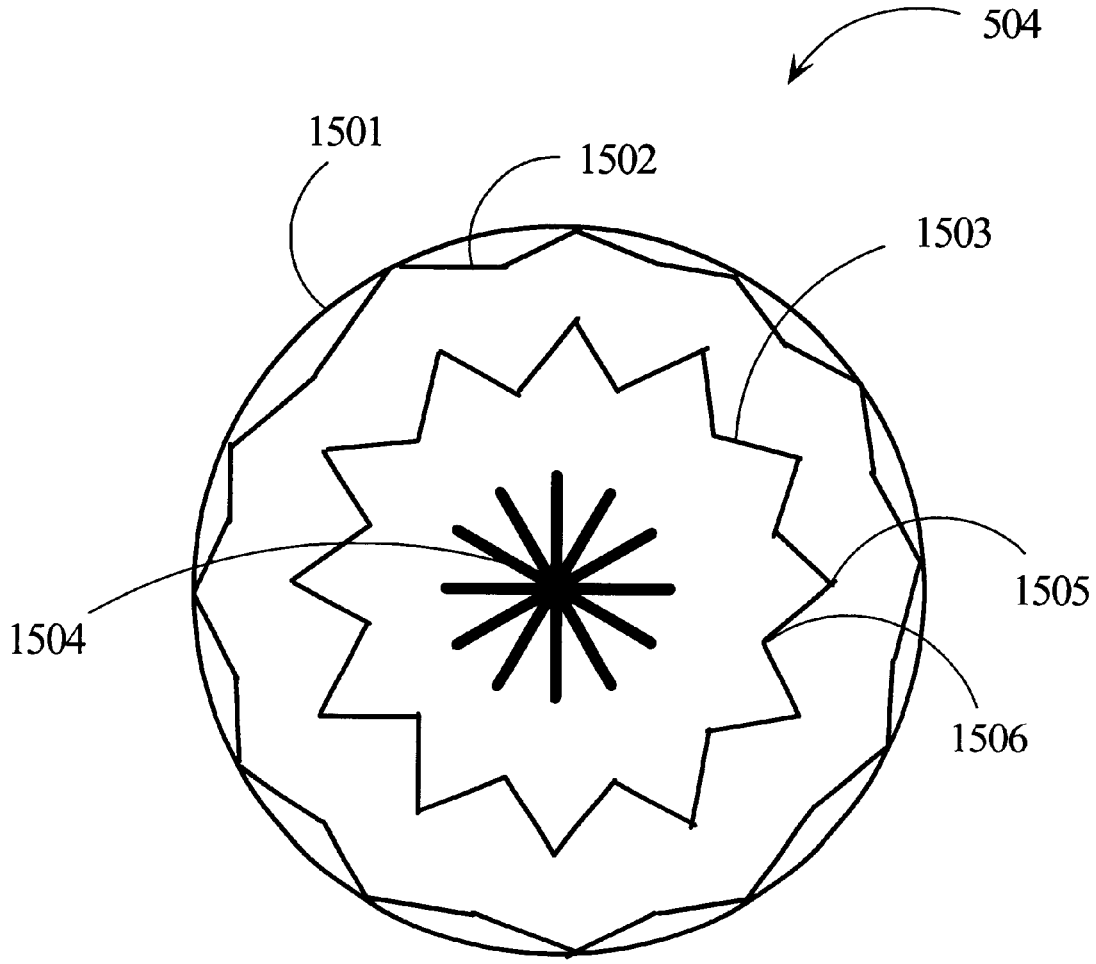
FIG. 15 illustrates details of an expandable bladder that is designed to collapse to a certain shape when evacuated.

FIG. 5B illustrates expandable bladder 504 that is also a type that expands by unfolding. Expandable bladder 504 is formed in such a way that it has a cross-section of a certain shape (e.g., star shaped) under no inflation pressure (internal pressure ambient atmospheric pressure). FIG. 15 shows additional details of expandable bladder 504 which is star shaped. A star shaped cross-section may be made by controlling wall thickness' of expandable bladder 504 during formation. In this way, expandable bladder 504 may be pressurized to a full, substantially circular cross-section or evacuated to a minimum size with a compressed star shaped cross-section. Expandable bladder 504 may be used with either a fabric loop corresponding to exemplary fabric loop 106 or fabric loop 301. Expandable bladder 504 is shown in compressed state 505 and expanded state 506. Cross-sections other than star shaped may be used and still be within the scope of the present invention.

FIG. 5C illustrates expandable bladder 507 which is yet another type useable with embodiments of the present invention. Expandable bladder 507 is made like a standard cylindrical balloon that assumes an elongated cylindrical shape when inflated. Expandable bladder 507 is shown in its deflated state 508. When pressurized air is supplied to expandable bladder 507, it substantially expands fully to its maximum diameter at a position determined by its tapered wall thickness. In its partially expansive state 509, expandable bladder 507 "pops" to its full diameter and then progressively expands (edge 510 progresses) along its length. If an inflatable bladder like 507 is inserted into an exemplary fabric loop 106, it expands a section of fabric loop 102 during the initial stages of expansion. If fabric loops 106 and 107 both had expandable bladders like 507, then the portion of area 132 of fabric layer 101 that is blocked would increasingly progress along the length of fabric loops 106 and 107.

Figure 6A:
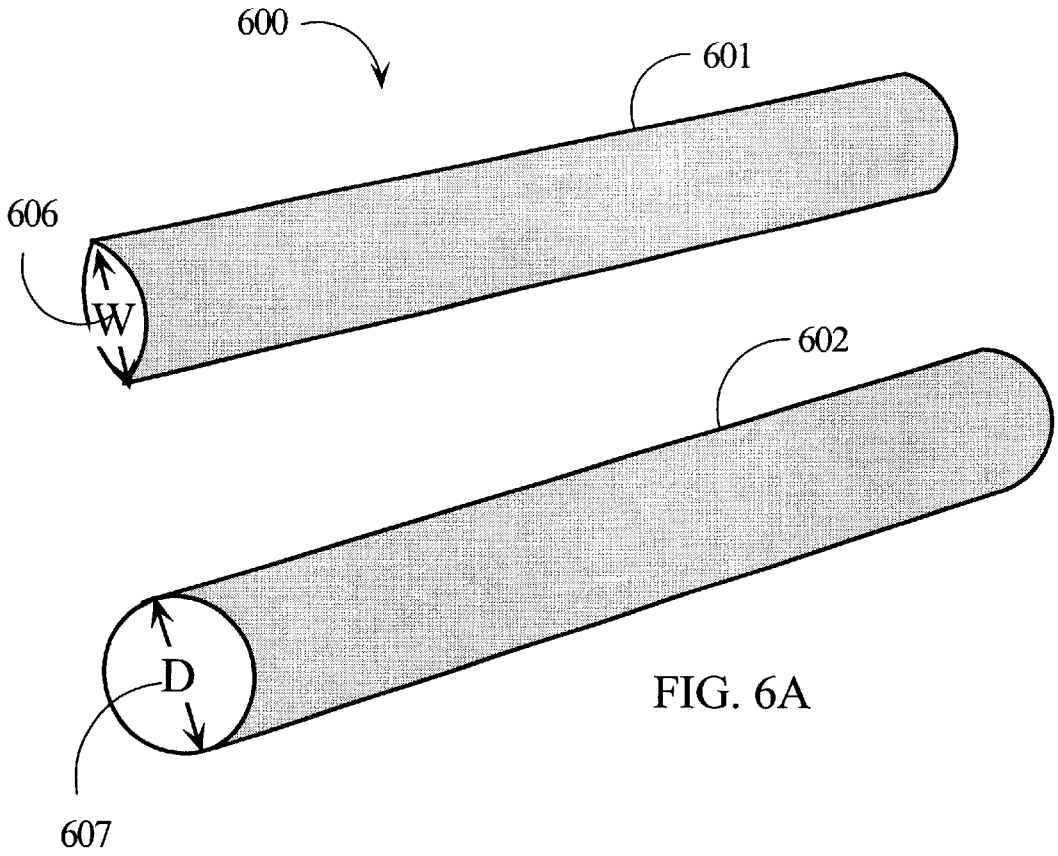
FIGS. 6A and 6B illustrate the geometry and dimensions of fabric loops when inflated and deflated.
Figure 6B:
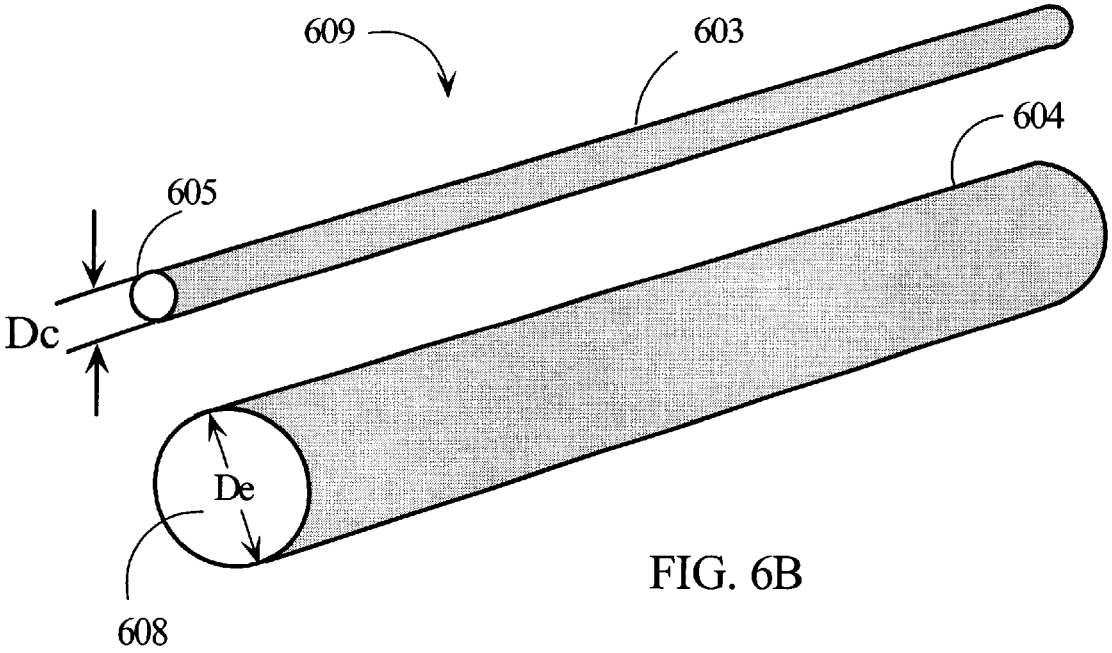

FIGS. 6A and 6B illustrate characteristics of the two types of fabric loops, for example, fabric loop 600 that does not stretch to expand and fabric loop 609 that stretches in a certain dimension when expanded. In FIG. 6A, fabric loop 600 is of the type that does not substantially stretch when expanded. Width W 606 represents the width of fabric loop 600 when flattened in its unexpanded state 601. When fabric loop 600 is fully expanded, it assumes a circular shape with a diameter D 607 illustrated in expanded state 602. Since the circumference of the circular shape of fabric loop 600 is equal to 2*W 606, the circular diameter of fabric loop 601 is 2*W 606/π when it is fully expanded. For adjacent fabric loops (e.g., fabric loops 102 and 103) like fabric loop 600 to touch when inflated, they may be spaced at an interval substantially equal to diameter D 607 or 2*W 606/π. Since W 606 is greater than 2*W 606/π, adjacent exemplary fabric loops 102 and 103 may overlap when not inflated and flattened. However, the material of the fabric loops like fabric loop 601 may be porous and designed to minimally affect the characteristics of a corresponding fabric layer (e.g., fabric layer 101) to which it is attached.

FIG. 6B illustrates fabric loop 609 that is of the type that expands by stretching. Fabric loop 609 is shown in its unexpanded state 603 and has a diameter Dc 605. When inflated, fabric loop 609 expands to a diameter De 608. If an expandable bladder like 501 or 504 is threaded in a fabric loop 603, then the diameter Dc 605 is sized to contain the bladder in its compressed state, for example compressed state 502 or compressed state 505. Fabric loop 609 may be designed to stretch preferably in diameter and only minimally length by using a material like Lycra®.

FIG. 7 illustrates a composite fabric 700 made using a fabric layer 761. Composite fabric 700 is made using an embodiment of the present invention where fabric layer 761 has various expandable bladders 713–722 threaded through corresponding fabric loops 701–710 and coupled to an air source 712 via an inflation tube 730. In this illustration, expandable bladders 713 and 714 are coupled to inflation tube 730 with air valve 723. Likewise, expandable bladders 715 and 716 are coupled to inflation tube 730 with air valve 724. Expandable bladders 717 and 718 are coupled to a inflation tube 730 with air valve 725, and expandable bladders 719–722 are coupled to inflation tube 730 with air valve 726. Having various expandable bladders coupled to an air source with separate air valves allows the degree of inflation of the selected expandable bladders to be individually controlled. For example, expandable bladders 713 and 714 are shown substantially deflated. Expandable bladders 715 and 716 are shown partially expanded, while expandable bladders 717 and 718 are shown fully expanded. Expandable bladder 719–722 are also shown substantially deflated. The fabric area 740 along and adjacent to expandable bladders 713 and 714 is substantially uncovered and substantially has the material characteristics of the material making up fabric layer 761. These material characteristics include thermal insulation, moisture transmission, and water vapor transmission. Fabric area 741 along and adjacent to partially inflated expandable bladder 716 and fully inflated expandable bladder 717 is partially covered by bladders 716 and 717 and their corresponding fabric loops 704 and 705. Most of the area 741 is thermally insulated by the air volume contained in expandable bladders 716 and 717. The small uncovered portion of area 741 would maintain the characteristics of the material of fabric layer 761. Fabric area 742, between fully inflated expandable bladders 717 and 718, is shown completely closed covered and insulated by the air in expandable bladders 717 and 718. Since expandable bladders 717 and 718 are air tight, they would also block water vapor or liquid water. Air source 712 has a air valve 750 that may be opened when air valves 723–726 are closed. Air source 712 may then be evacuated creating a vacuum. If selected ones of air valves 723–726 are then opened, the corresponding coupled expandable bladders 713–722 may be deflated below ambient air pressure. Air source 712 may be as simple as an air bulb used on blood pressure testing units. Controllable check valves are contained in the air valves 750 and 751 so that air may be correctly directed when inflating and deflating expandable bladders leaving multiple air valves 723–726 to simple pass or block air flow to their corresponding expandable bladders. Other fabric areas adjacent to other expandable bladders in FIG. 7 which experience a variable thermal insulation may not be highlighted or numbered to minimize the detail on FIG. 7.

Figure 8:
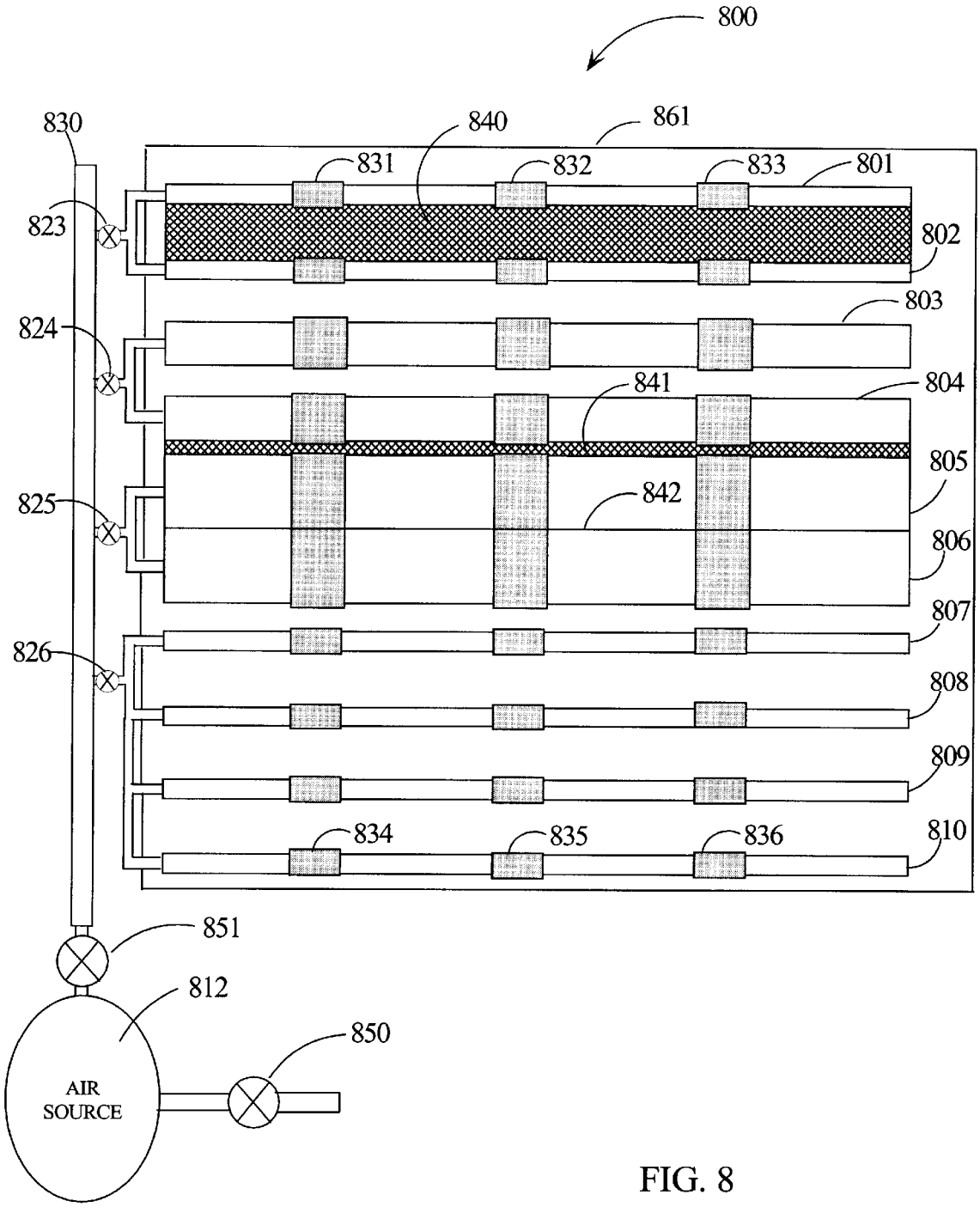
FIG. 8 illustrates a fabric layer with segmented fabric loops with expandable bladders connected to an air source via air valves and an inflation tube.

FIG. 8 illustrates composite fabric 800 with fabric layer 861. Composite fabric 800 is made using an embodiment of the present invention where fabric layer 861 has various expandable bladders 801–810 coupled to an air source 812. Expandable bladders 801–810 are threaded through corresponding attached segmented fabric loops. For example, expandable bladder 801 is coupled to fabric layer 861 with segmented fabric loops 831–833. Likewise, expandable bladder 810 is coupled to fabric layer 861 with segmented fabric loops 834–836.

In FIG. 8, expandable bladders 801 and 802 are coupled to inflation tube 830 with air valve 823. Likewise, expandable bladders 803 and 804 are coupled to inflation tube 830 with air valve 824. Expandable bladders 805 and 806 are coupled to a inflation tube 830 with air valve 825 and expandable bladders 807–810 are coupled to inflation tube 830 with air valve 826. Having various expandable bladders coupled to an air source with separate air valves allows the degree of inflation or deflation of selected expandable bladders to be individually controlled. For example, expandable bladders 801 and 802 are shown substantially deflated. Expandable bladders 803 and 804 are shown partially inflated, while expandable bladders 805 and 806 are shown fully inflated. Expandable bladders 807–810 are also shown substantially deflated. The fabric area 840 of fabric layer 861 between expandable bladders 801 and 802 is substantially uncovered and has the characteristics of the material making up fabric layer 861 including thermal insulation and moisture and water vapor transmission. Fabric area 841 between partially inflated expandable bladder 804 and fully inflated expandable bladder 805 is partially covered by expandable bladders 804 and 805. Most of the fabric area 841 is thermally insulated by the air volume contained in expandable bladders 804 and 805. The small uncovered portion of fabric area 841 would retain the material characteristics of the material of fabric layer 861. The fabric area 842, between fully inflated expandable bladders 805 and 806, is shown completely covered and insulated by the air in expandable bladders 805 and 806. Since expandable bladders 805 and 806 are air tight, they would naturally also block water vapor or liquid water. Air source 812 has an air valve 850 that may be opened when air valves 823–826 are closed. Air source 812 may then be evacuated creating a vacuum. If selected ones of air valves 823–826 are then opened, the corresponding coupled expandable bladders 801–810 may be deflated below ambient air pressure. Air source 812 may be as simple as an air bulb used on blood pressure testing unit. Controllable check valves are contained in the air valves 850 and 851 so that air may be correctly directed when inflating and deflating expandable bladders 801–810 leaving multiple air valves 823–826 to simple pass or block air flow to their corresponding expandable bladders 801–810. Other fabric areas adjacent to other expandable bladders in FIG. 8 which experience a variable thermal insulation may not be highlighted or numbered to minimize the detail on FIG. 8.

Figure 9A:
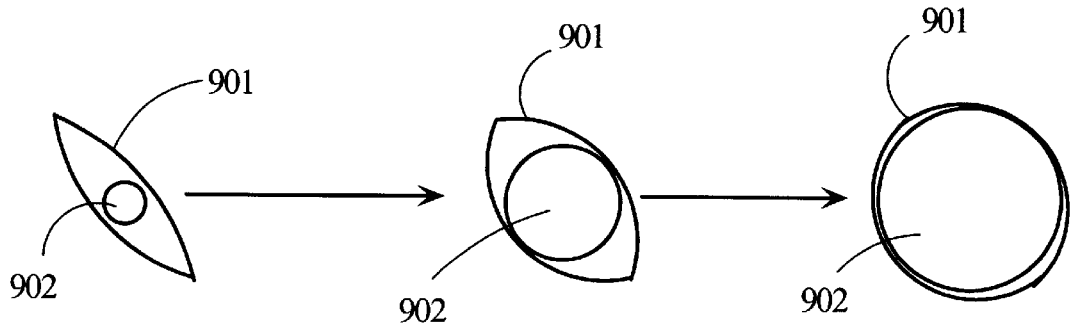
FIGS. 9A, 9B, and 9C illustrate non-stretch fabric loops with different types of expandable bladders in various stages of inflation.
Figure 9B:
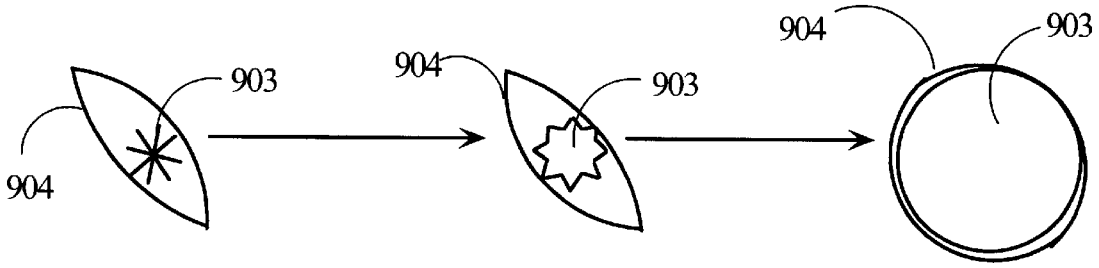
Figure 9C:
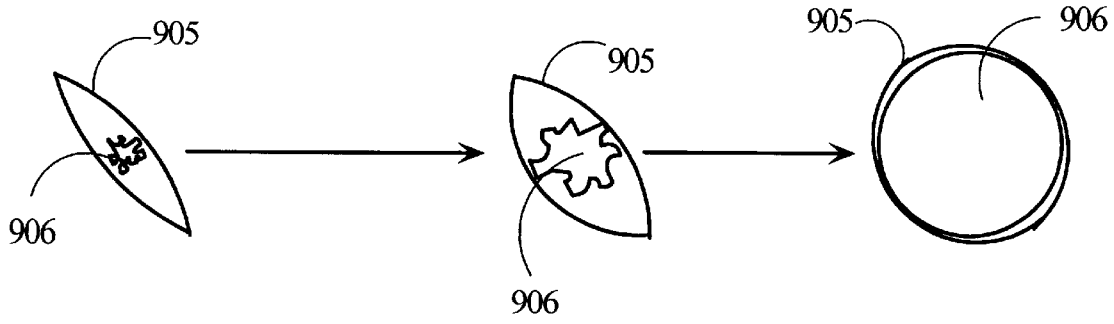

FIGS. 9A, 9B, and 9C illustrate various fabric loops 901, 904, and 905 with various expandable bladder types 902, 903, and 906. Progressing from left to right, fabric loop 901 is shown expanding as corresponding expandable bladder 902 inflates. FIG. 9A illustrates fabric loop 901 which is substantially flat when expandable bladder 902 is deflated. As expandable bladder 902 inflates, it contacts the walls of fabric loop 901 and fabric loop 901 will eventually assume the shape of expandable bladder 902. In this embodiment, fabric loop 901 is designed not to stretch.

FIG. 9B illustrates expandable bladder 903 in fabric loop 904. Expandable bladder 903 has a star shaped cross-section (see detail illustrated in FIG. 15) that has a certain shape when deflated and collapsed. As expandable bladder 903 is pressurized, it will expand while keeping its star like shape characteristic. Eventually, expandable bladder 903 will expand to the constraints of fabric loop 904 and assume a substantially circular shape.

FIG. 9C illustrates fabric loop 905 which contains expandable bladder 906 that has a crumpled deflated state with no particular geometry. As expandable bladder 906 is pressurized, it unfolds and starts to assume a somewhat circular shape. When expandable bladder 906 is fully expanded, it also will assume a circular shape corresponding to the constraints of fabric loop 905.

Figure 10A:
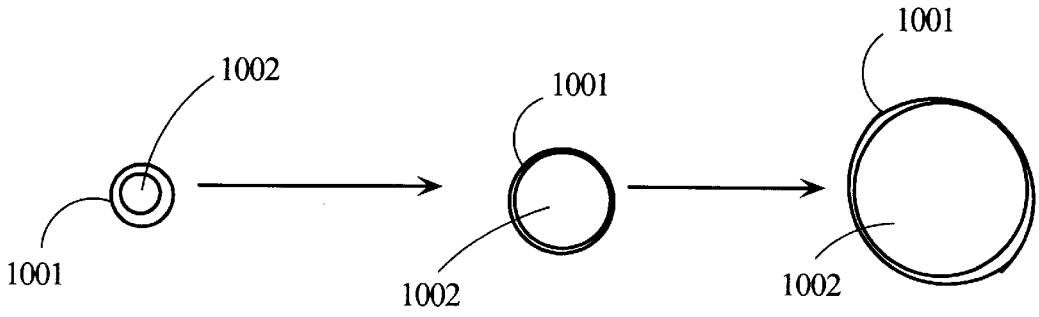
FIGS. 10A, 10B, and 10C illustrate stretchable fabric loops with different types of expandable bladders in various stages of inflation.
Figure 10B:
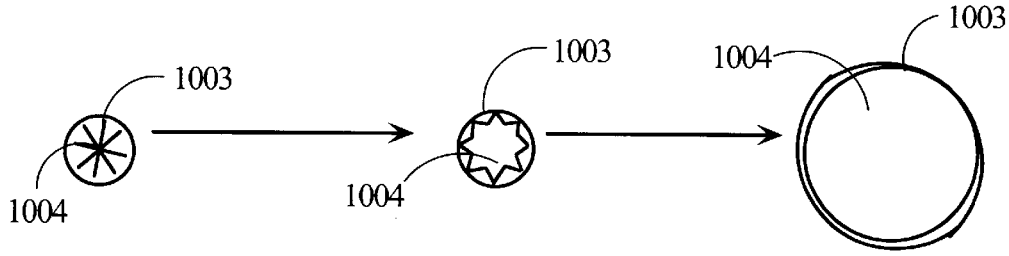
Figure 10C:
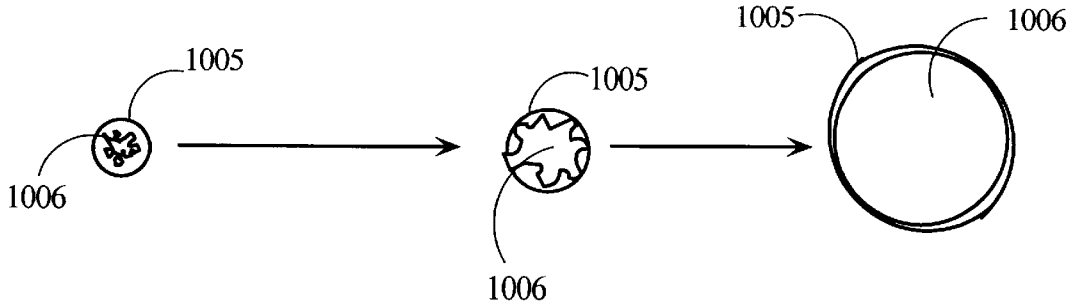

FIGS. 10A, 10B, and 10C illustrate three types of extendable bladders 1002, 1004, and 1006 threaded through corresponding fabric loops 1001, 1004, 1005 that stretch when expanded. Fabric loops 1001, 1003, 1005 stretch and assume the inflated shaped of their corresponding expandable bladders 1002, 1004, and 1006 and these fabric loops may aid to compress their corresponding expandable bladder to a minimum size when they are deflated. Fabric loops 1001, 1003, and 1005 may be made from a Lycra® material that stretches primarily in a radial direction and minimally in length. Extendable bladders 1002, 1004, and 1006 may be one of the described types (e.g., expandable bladders 501 and 504) that compress to a minimum cross-section when deflated aided by the contraction force of their corresponding stretched fabric loops 1001, 1003, and 1005.

Figure 11:
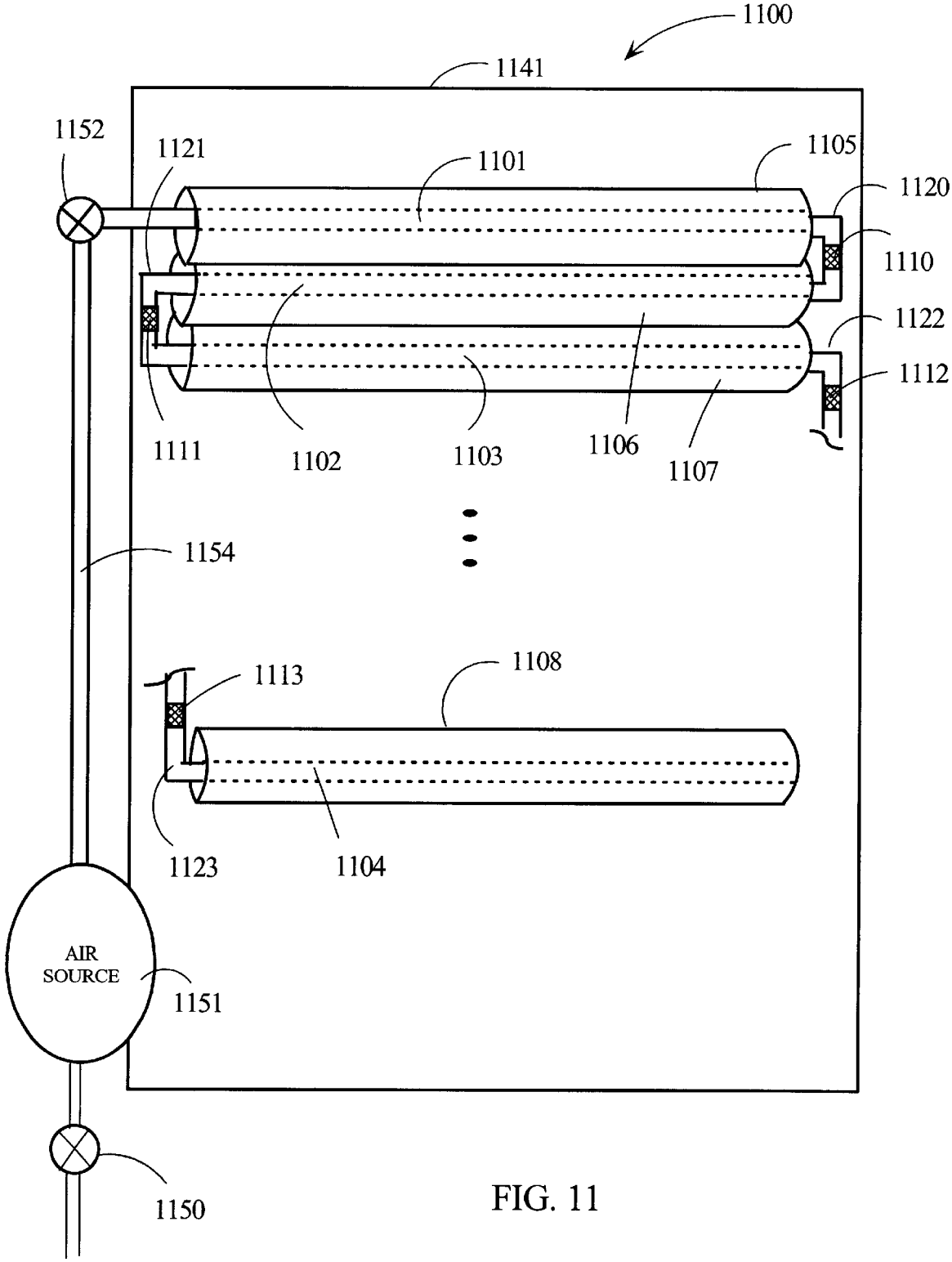
FIG. 11 illustrates a number of expandable bladders coupled together in series with flexible adapters that allow the composite fabric to bend along the width axis.

FIG. 11 illustrates a composite fabric 1100 using fabric layer 1141 with segmented expandable bladders 1101–1104 attached with fabric loops 1105–1108. In this embodiment, inflation tube couplings 1120–1123 are used to couple the segmented expandable bladders 1101–1104 in a series connection. The inflation tube couplings 1120–1123 have corresponding flexible sections 1110–1113 that facilitate bending of the composite fabric 1100 along the width dimension (vertical in this illustration). The series connection of expandable bladders 1101–1104 is coupled via inflation tube 1154 and air valve 1152 to air source 1151. Air source 1151 may be as simple as an air bulb used on blood pressure testing units. Controllable check valves are contained in the air valves 1150 and 1152 so that air may be correctly directed when inflating and deflating segmented expandable bladders 1101–1104. Segmented expandable bladders 1101–1104 may be of the types detailed in FIG. 5 and explained earlier. Other embodiments of the present invention may not use inflation tube couplings 1120–1123, rather expandable bladder 1101 is continuously threaded through fabric loops 1105–1108 and inflated and deflated as one long expandable bladder.

Figure 12:
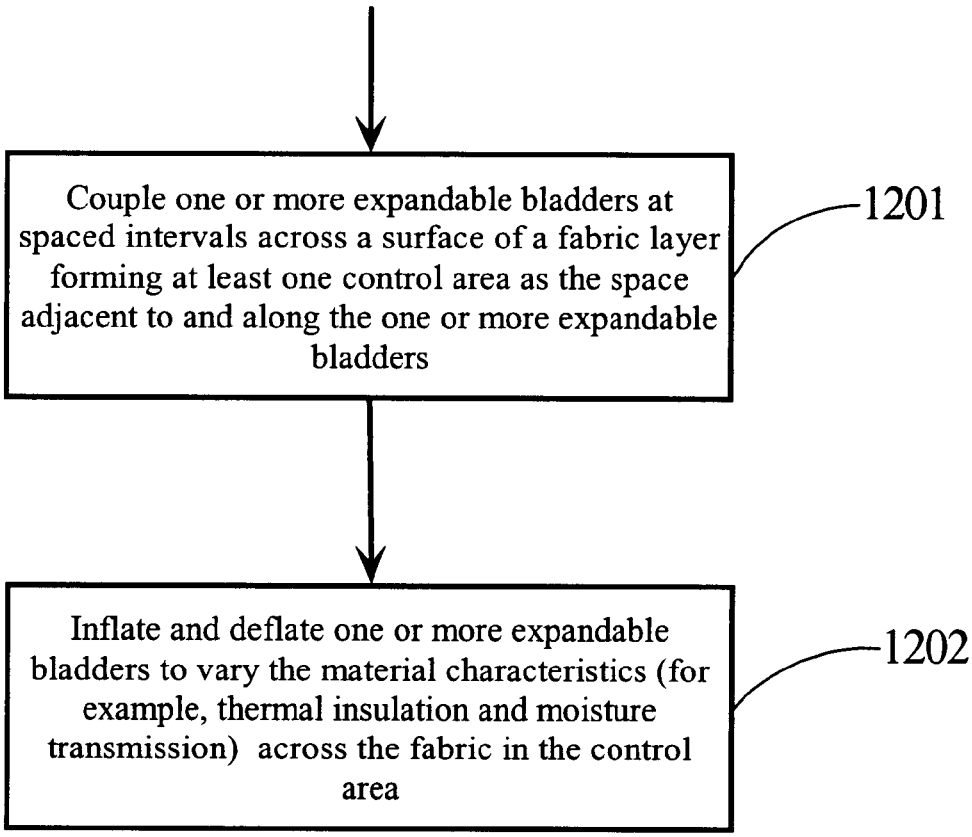
FIG. 12 is a flow chart of method steps in an embodiment of the present invention.

FIG. 12 is a flow diagram of method steps used in embodiments of the present invention. In step 1201, one or more expandable bladders (e.g., expandable bladders 713–722) are attached to a fabric layer 761 defining fabric areas adjacent to expandable bladders (e.g., fabric areas 740 and 741). In step 1202, selected expandable bladders from the one or more expandable bladders are inflated and deflated selectively covering and uncovering a selected fabric area (e.g., fabric area 741) with portions of the corresponding inflated and deflated expandable bladders (e.g., expandable bladders 716 and 717) so that the material characteristics (e.g., thermal insulation and moisture transmission) across the fabric area 741 of fabric layer 761 are varied.

Figure 13A:
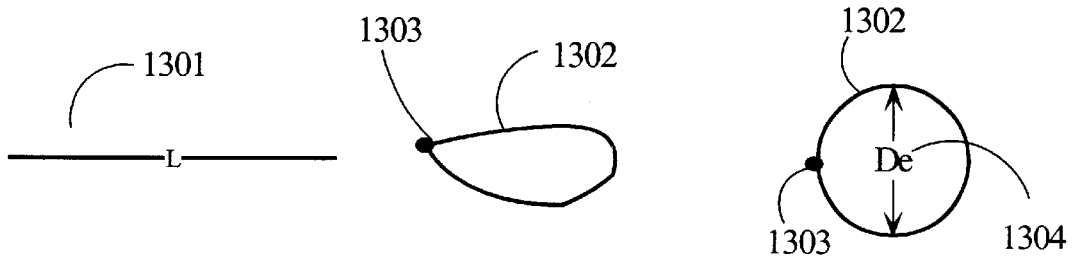
FIGS. 13A, 13B, and 13C illustrate some various ways fabric loops may be fabricated.
Figure 13B:
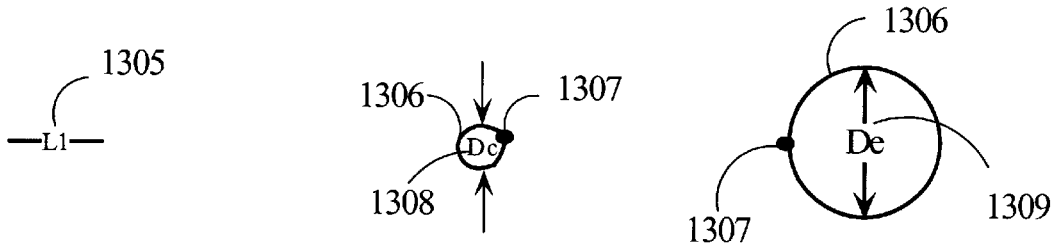
Figure 13C:
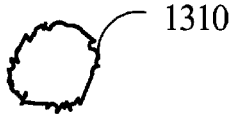

FIGS. 13A, 13B, and 13C illustrate fabrications of fabric loops usable with embodiments of the present invention. The fabric loops are shown in edge views so that a corresponding width of the fabric loops is not visible. FIG. 13A illustrates a fabric loop 1302 which is formed by folding a length L of non-stretching fabric 1301 and joining at point 1303. When fabric loop 1302 is expanded with an expandable bladder (not shown), it will assume a circular shape with a diameter De 1304 equal to L divided by the number $\pi$. FIG. 13B illustrates a stretchable fabric loop 1306 which may be formed with a length L1 of stretchable material 1305 which has been folded and joined at 1307. Stretching fabric loop 1306, expands it to an expanded diameter De 1309. FIG. 13C illustrates another fabric loop 1310 which is woven with a weaving or knitting machine to make fabric loop 1310 non-seamed.

Figure 14A:
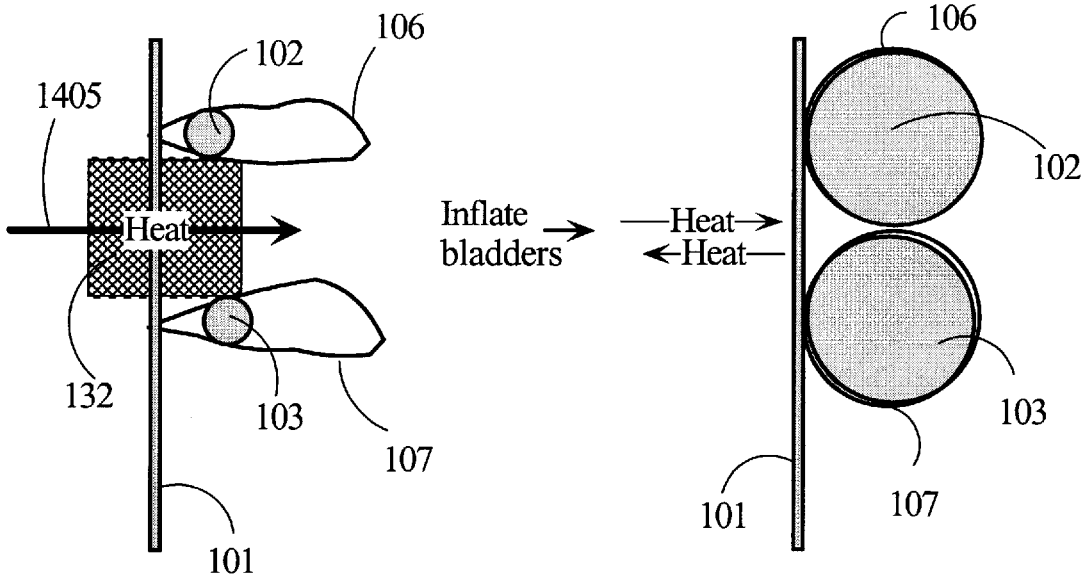
FIGS. 14A and 14B illustrate how the area adjacent to and along selected expandable bladders is modified by inflating and deflating the selected expandable bladders.
Figure 14B:
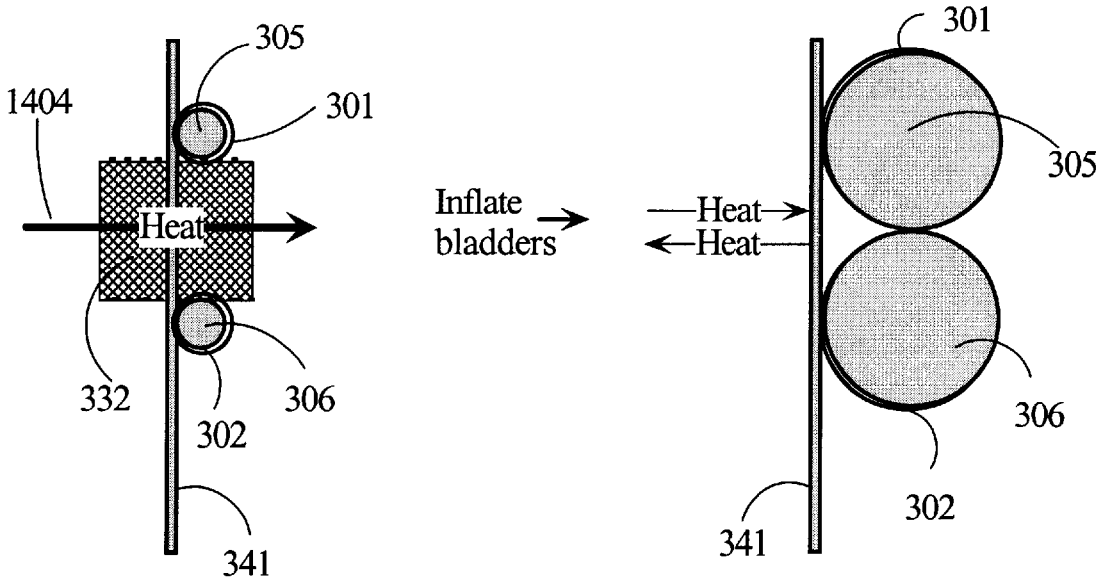

FIGS. 14A and 14B are alternate perspective views showing a cross-section of fabric areas 132 and 332 and how they are affected by inflating their corresponding expandable bladders. FIG. 14A is a side view of composite fabric 100 showing non-stretching fabric loops 106 and 107. Fabric loops 106 and 107 have deflated expandable bladders 102 and 103 which shows the portion of the cross section of fabric area 132 (see FIG. 1) of fabric 101 with an unmodified thermal insulation. Expandable bladders 102 and 103 selectively cover and uncover fabric area 132 to vary the thermal insulation across fabric area 132. Arrow 1405 illustrates the heat transfer path through fabric layer 101. The volume of air in fully inflated expandable bladders 102 and 103 completely blocks fabric area 132 of fabric 101 and generates a maximum thermal insulation for fabric area 132.

FIG. 14B is a side view of composite fabric 300 showing a cross section of stretching fabric loops 301 and 302. Fabric loops 301 and 302 have deflated expandable bladders 305 and 306 which shows the portion of fabric area 332 (see FIG. 3) of fabric layer 341 with an unmodified thermal insulation. Expandable bladders 305 and 306 selectively cover and uncover fabric area 332 to vary the thermal insulation across fabric area 332. Arrow 1404 illustrates the heat transfer path through fabric layer 341. The volume of air in fully inflated expandable bladders 305 and 306 completely blocks fabric area 332 of fabric 101 and generates a maximum thermal insulation for fabric area 332.

FIG. 15 illustrates details of exemplary expandable bladder 504 that is designed to have a star shape when it collapses after evacuation. Expandable bladder 504 has a star shaped cross-section discussed earlier that may be formed by extruding a flexible material with controlled wall thickness' (e.g., 1505 and 1506). For example, expandable bladder 504 may be extruded into the shape 1503 at atmospheric pressure. If a bladder 504 is further evacuated, then it will compress to the shape illustrated by shape 1504. As expandable bladder 504 is inflated, it may assume a shape 1502 and finally shape 1501 when fully inflated. Expandable bladder 504 may also be formed by folding and joining a flexible material to make a circular shape. Other types of expandable bladders that collapse to a certain minimum cross-section when deflated may also be used without departing from the scope of the present invention.

Figure 16A:
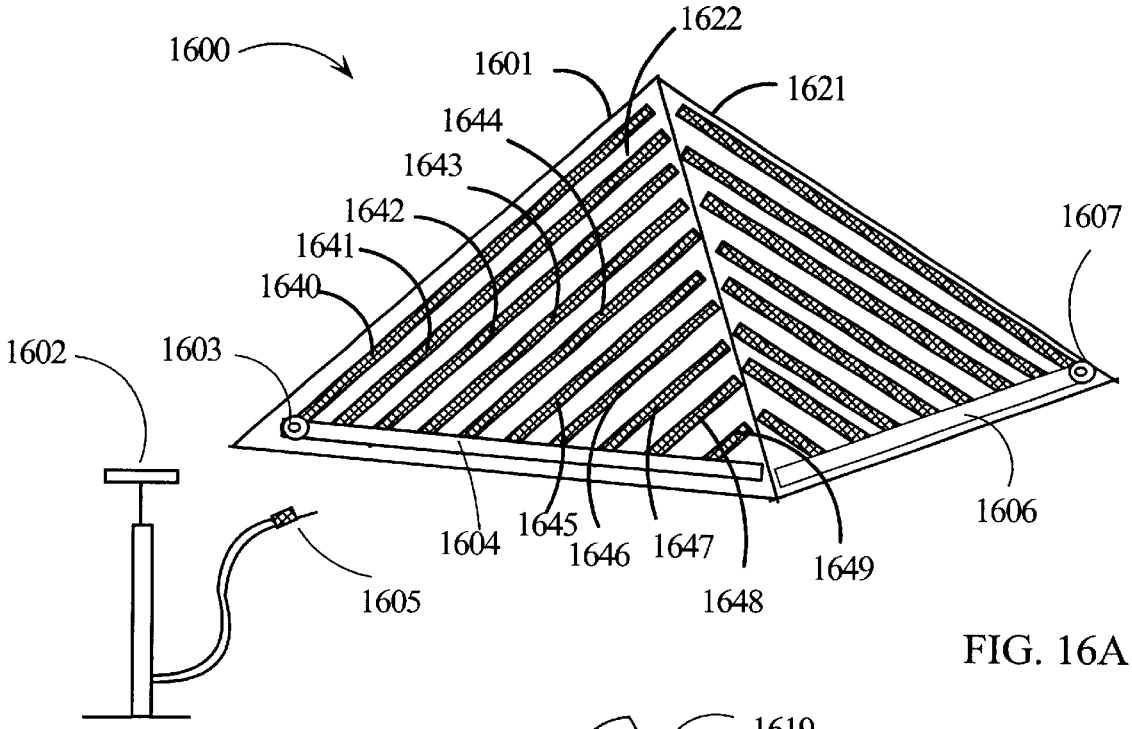
FIGS. 16A and 16B illustrate two fabric products made with composite fabric according to one embodiment of the present invention.
Figure 16B:
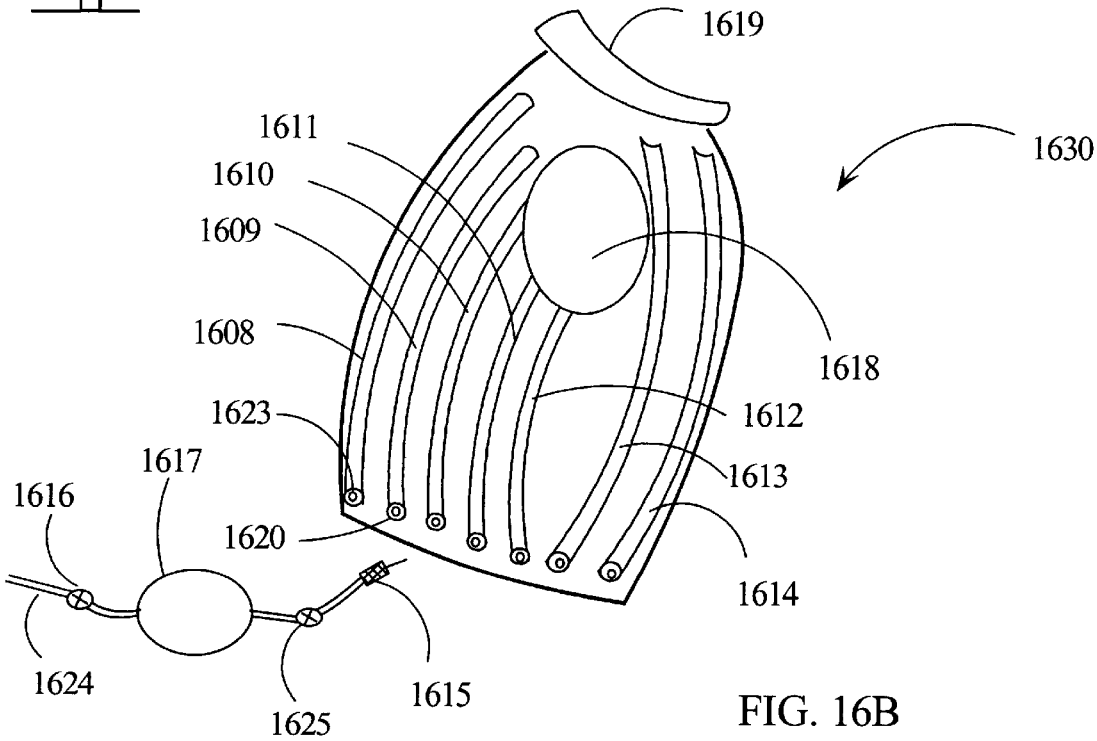

FIGS. 16A and 16B illustrate fabric products using a composite fabric made according to embodiments of the present invention. FIG. 16A illustrates a tent 1600 that has two triangular composite fabric sections 1601 and 1621. The composite fabric sections 1601 and 1621 have expandable bladders with different bladder lengths across their surface. Composite fabric section 1601 has expandable bladders 1640–1649 attached with fabric loops (not shown) to its surface. Expandable bladders 1640–1649 are coupled in parallel with inflation tube 1604. An air source 1602 (shown as a tire pump with adapter 1605) may be coupled to inflation tube 1604 via air valve 1603 and used to inflate expandable bladders 1640–1649 to selectively cover the area adjacent to and along the bladder lengths of the expandable bladders 1640–1649. Air valve 1603 may be like any of a number of readily available air valves, for example an automobile tire air valve or a football air valve. Adapter 1605 is selected to be compatible with the particular air valve used. Area 1622 is an exemplary area adjacent to and along expandable bladders 1640 and 1641. The expandable bladders (not numbered) on the surface of composite fabric section 1621 are coupled in parallel with inflation tube 1606 and use air valve 1607. If composite fabric section 1601 needed the maximum thermal insulation, then expandable bladders 1640–1649 are completely inflated covering substantially all the area of composite fabric section 1601. When expandable bladders 1640–1649 are fully inflated, composite fabric section 1601 would have its maximum thermal insulation. In other embodiments, each expandable bladder has its own air valve so that more control over the thermal insulation is possible. Expandable bladders 1640–1649 may be made and attached according to any of the embodiments illustrated in FIGS. 1, 2, 3, 4, 5, 6, 7, 8, 9A–9C, 10A–10C, 11, 13, 14, and 15.

FIG. 16B illustrates a side view of a fabric product in the form of a vest garment 1630 worn by an individual. Vest garment 1630 has expandable bladders 1608–1614 attached to its fabric surface with fabric loops (not shown). Vest garment 1630 has collar piece 1691 and arm opening 1618. Expandable bladders 1608–1614 each have individual air valves, for example, air valves 1623 and 1620 on expandable bladders 1608 and 1609 respectively. Using individual air valves allows the thermal insulation of smaller areas of vest garment 1630 to be varied by expanding selected ones of expandable bladders 1608–1614. In FIG. 16B, an air source 1617 is shown as an air bulb like one used on a blood pressure measurement apparatus. Adapter 1615 is compatible with the corresponding air valves used on expandable bladders 1608–1614. Air control valves 1616 and 1625 are used to control when air is pumped into or evacuated from the expandable bladders 1608–1614 via hose 1624. Expandable bladders 1608–1614 may be made and attached according to any of the embodiments illustrated in FIGS. 1, 2, 3, 4, 5, 6, 7, 8, 9A–9C, 10A–10C, 11, 13, 14, and 15.

Other fabric products that may be made with composite fabric according to embodiments of the present invention include but are not limited to an air mattress, shoes, a hat, and boots. Tent 1600 and vest garment 1630 illustrated in FIGS. 16A and 16B may have a second fabric layer attached and covering their corresponding expandable bladders for aesthetics and for additional protection of the expandable bladders. Also the expandable bladders in FIGS. 16A and 16B are shown on the outside of the fabric products for illustration purposes only. Expandable bladders 1640–1649 may be on the inside of tent 1600 and still be within the scope of the present invention. Likewise, expandable bladders 1608–1614 may be on the inside of vest garment 1630 and still be within the scope of the present invention.

What is claimed is:

1. A composite fabric comprising:

a first fabric layer;

one or more expandable bladders coupled to a surface of said first fabric layer at spaced intervals across said surface and extending corresponding bladder lengths across said surface in a direction substantially transverse to a direction of said spaced intervals defining fabric areas of said first fabric layer adjacent to each of said corresponding bladder lengths of said one or more expandable bladders; and an inflation coupling device for selectively coupling said one or more expandable bladders to an air source for inflating and deflating one or more first expandable bladders selected from said one or more expandable bladders thereby selectively covering and uncovering first fabric areas corresponding to said one or more first expandable bladders.

2. The composite fabric of claim 1, wherein selectively covering and uncovering said first fabric areas varies a thermal insulation of said first fabric areas.

3. The composite fabric of claim 1, wherein each of said one or more expandable bladders is coupled to said surface by threading through a fabric loop attached to said surface of said first fabric layer forming a threaded expandable bladder.

4. The composite fabric of claim 3, wherein said fabric loop extends continuous around and over a bladder length of a corresponding threaded expandable bladder.

5. The composite fabric of claim 3, wherein said fabric loop is a segmented fabric loop such that said segmented fabric loop only extends around and over portions of a bladder length of a corresponding threaded expandable bladder.

6. The composite fabric of claim 3, wherein said fabric loop expands without stretching to a first expanded diameter substantially equal to an expanded bladder diameter of said threaded expandable bladder.

7. The composite fabric of claim 6, wherein said threaded expandable bladder stretches to said first expanded diameter thereby thinning a material wall thickness forming said threaded expandable bladder.

8. The composite fabric of claim 7, wherein said threaded expandable bladder has a tapered wall thickness along a bladder length of said threaded expandable bladder.

9. The composite fabric of claim 8, wherein said threaded expandable bladder preferably expands to said first expanded diameter of said corresponding fabric loop over a portion of a bladder length of said threaded expandable bladder and expansion of said threaded expandable bladder progresses across said bladder length in response to increasing air pressure within said threaded expandable bladder.

10. The composite fabric of claim 6, wherein said fabric loop, attaching adjacent expandable bladders selected from said one or more expandable bladders, has an expanded diameter substantially equal to an attachment point spacing between said adjacent expandable bladders.

11. The composite fabric of claim 3, wherein said fabric loop expands by stretching to an expanded diameter of a corresponding threaded expandable bladder, said fabric loop contracting to a non-stretched diameter when said corresponding threaded expandable bladder is deflated.

12. The composite fabric of claim 11, wherein said fabric loop comprises a material which stretches in a certain direction.

13. The composite fabric of claim 11, wherein said fabric loop, attaching adjacent expandable bladders selected from said one or more expandable bladders stretches to a diameter substantially equal to an attachment point spacing between said adjacent expandable bladders.

14. The composite fabric of claim 1, wherein said first fabric layer is attached to a second fabric layer, said second fabric layer disposed substantially in parallel with said first fabric layer and covering said one or more expandable bladders.

15. The composite fabric of claim 14, wherein said second fabric layer is attached to said surface of said first fabric layer at first spaced intervals.

16. The composite fabric of claim 1, wherein said first fabric layer comprises a material which blocks liquid moisture while passing water vapor.

17. The composite fabric of claim 1, wherein first expandable bladders of said one or more expandable bladders are selectively coupled to said inflation coupling device with air valves for controlling when said first expandable bladders are inflated or deflated.

18. The composite fabric of claim 1, wherein said one or more expandable bladders expand by unfolding from a collapsed state without substantially stretching a wall thickness forming each said one or more expandable bladders.

19. The composite fabric of claim 18, wherein said one or more expandable bladders has a certain collapsed cross-section when deflated, said certain collapsed cross-section predisposed by forming said one or more expandable bladders during fabrication.

20. The composite fabric of claim 19, wherein said one or more expandable bladders have deflated cross-sections corresponding to a star pattern formed by extruding said one or more expandable bladders with a controlled, variable bladder wall thickness forming each of said one or more expandable bladders, each of said one or more expandable bladders further collapsing to a minimum cross-section area when evacuated.

21. The composite fabric of claim 1, wherein at least two of said one or more expandable bladders are coupled in series with an inflation tube coupling.

22. The composite fabric of claim 21, wherein said inflation tube coupling is flexible and facilitates bending of said composite fabric along said spaced interval direction.

23. A fabric product formed into a shape and having a product surface with a thermal insulation that is varied by inflating and deflating one or more expandable bladders coupled on said product surface to selectively cover and uncover fabric areas of said product surface with said one or more expandable bladders.

24. The fabric product of claim 23, wherein said product surface further comprises:

a first fabric layer with said one or more expandable bladders coupled to a surface of said first fabric layer at spaced intervals across said surface and extending corresponding bladder lengths across said surface in a direction substantially transverse to a direction of said spaced intervals defining said fabric areas of said first fabric layer adjacent to each of said corresponding bladder lengths of said one or more expandable bladders; and an inflation coupling device for selectively coupling said one or more expandable bladders to an air source for inflating and deflating one or more first expandable bladders selected from said one or more expandable bladders thereby selectively covering and uncovering first fabric areas corresponding to said one or more first expandable bladders.

25. The fabric product of claim 24, wherein each of said one or more expandable bladders is attached to said surface by threading through a fabric loop attached to said surface of said first fabric layer forming a threaded expandable bladder.

26. The fabric product of claim 25, wherein said second fabric layer is attached to said surface of said first fabric layer at first spaced intervals.

27. The fabric product of claim 24, wherein said first fabric layer comprises a material which blocks liquid moisture while passing water vapor.

28. The fabric product of claim 27, wherein said threaded expandable bladder stretches to said first expanded diameter thereby thinning a material wall thickness forming said threaded expandable bladder.

29. The fabric product of claim 28, wherein said threaded expandable bladder preferably expands to said first expanded diameter of said corresponding fabric loop over a portion of a bladder length of said threaded expandable bladder and expansion of said threaded expandable bladder progresses across said bladder length in response to increasing air pressure within said threaded expandable bladder.

30. The fabric product of claim 29, wherein said one or more expandable bladders has a certain collapsed cross-section when deflated, said certain collapsed cross-section predisposed by forming said one or more expandable bladders during fabrication.

31. The fabric product of claim 27, wherein said fabric loop, attaching adjacent expandable bladders selected from said one or more expandable bladders, has an expanded diameter substantially equal to an attachment point spacing between said adjacent expandable bladders.

32. The fabric product of claim 24, wherein said one or more expandable bladders expand by unfolding from a collapsed state without substantially stretching a wall thickness forming each said one or more expandable bladders.

33. The fabric product of claim 32, wherein said one or more expandable bladders have deflated cross-sections corresponding to a star pattern formed by extruding said one or more expandable bladders with a controlled, variable bladder wall thickness forming each of said one or more expandable bladders, each of said one or more expandable bladders further collapsing to a minimum cross-section area when evacuated.

34. The fabric product of claim 33, wherein said inflation tube coupling is flexible and facilitates bending of said composite fabric along said spaced interval direction.

35. The fabric product of claim 24, wherein said first fabric layer is attached to a second fabric layer, said second fabric layer disposed substantially in parallel with said first fabric layer and covering said one or more expandable bladders.

36. The fabric product of claim 24, wherein first expandable bladders of said one or more expandable bladders are selectively coupled to said inflation coupling device with air valves for controlling when said first expandable bladders are inflated or deflated.

37. The fabric product of claim 24, wherein at least two of said one or more expandable bladders are coupled in series with an inflation tube coupling.

38. The fabric product of claim 24, wherein said fabric product comprise a tent, a sleeping bag, an air mattress, a garment worn by a person, shoes, and boots.

39. The fabric product of claim 24, wherein selectively covering and uncovering said first fabric areas varies a thermal insulation of said first fabric areas.

40. The fabric product of claim 39, wherein said fabric loop expands by stretching to an expanded diameter of a corresponding threaded expandable bladder, said fabric loop contracting to a non-stretched diameter when said corresponding threaded expandable bladder is deflated and evacuated.

41. The fabric product of claim 39, wherein said fabric loop extends continuous around and over a bladder length of a corresponding expandable bladder.

42. The fabric product of claim 39, wherein said fabric loop is a segmented fabric loop such that said segmented fabric loop only extends around and over portions of a bladder length of a corresponding threaded expandable bladder.

43. The fabric product of claim 39, wherein said fabric loop expands without stretching to a first expanded diameter substantially equal to an expanded bladder diameter of said threaded expandable bladder.

44. If The fabric product of claim 43, wherein said fabric loop comprises a material which stretches in a certain direction.

45. The fabric product of claim 44, wherein said threaded expandable bladder has a tapered wall thickness along a bladder length of said threaded expandable bladder.

46. The fabric product of claim 43, wherein said fabric loop, attaching adjacent expandable bladders selected from said one or more expandable bladders stretches to a diameter substantially equal to an attachment point spacing between said adjacent expandable bladders.

47. A method for varying a thermal insulation of a fabric area of a first fabric layer comprising the steps of:

coupling one or more expandable bladders to a surface of said first fabric layer at spaced intervals across said surface and extending corresponding bladder lengths across said surface in a direction substantially transverse to a direction of said spaced intervals, said fabric area defined as an area along and adjacent to a bladder length of one or more first expandable bladders selected from said one or more expandable bladders; and inflating and deflating said one or more first expanded bladders to vary said thermal insulation of said fabric area.

48. The method of claim 47, wherein each of said one or more expandable bladders is coupled to said surface by threading through a fabric loop attached to said surface of said first fabric layer forming a threaded expandable bladder.

49. The method of claim 47, wherein said first fabric layer is attached to a second fabric layer, said second fabric layer disposed substantially in parallel with said first fabric layer and covering said one or more expandable bladders.

50. The method of claim 47, wherein said first fabric layer comprises a material which blocks liquid moisture while passing water vapor.

* * * * *